US006098540A

United States Patent [19]

Vrotacoe et al.

[11] Patent Number: 6,098,540

[45] Date of Patent: Aug. 8, 2000

[54] APPARATUS AND METHOD FOR REDUCING MOTTLING IN PRINTING PRESSES

[75] Inventors: James Brian Vrotacoe, Rochester, N.H.; Edward Ellis Urquhart, Northboro, Mass.

[73] Assignee: Heidelberger Druckmaschinen AG, Heidelberg, Germany

[21] Appl. No.: 09/131,564

[22] Filed: Aug. 10, 1998

[51] Int. Cl.[7] ..... B41F 9/00

[52] U.S. Cl. ..... 101/142; 101/375; 101/148

[58] Field of Search ..... 101/142, 148, 101/216, 348, 352.1, 375, 379

[56] References Cited

U.S. PATENT DOCUMENTS 5,816,150 10/1998 Sarda ..... 101/142

*Primary Examiner*—Christopher A. Bennett
*Attorney, Agent, or Firm*—Kenyon & Kenyon

[57] ABSTRACT

An apparatus and method which reduces solid mottling in an offset printing press. One or more form rolls having a hard elastomeric outer surface, in the range of approximately 50–100 Shore A durometer hardness, preferably approximately 60–90 Shore A durometer hardness, are used to transfer ink to the plate cylinder. The use of a form roll of this type ensures a smoother application of ink to the plate cylinder, which in turn ensures smoother ink application to the blanket cylinder and printed web. If more than one form roll is used, it is preferable that, at a minimum, the final form roll, i.e., the last form roll the plate cylinder contacts in the direction of rotation, be a hard elastomeric form roll. In another aspect of the present invention, the form rolls can be made of a convex shape along their axial length, such that the diameter of the form rolls at their axial center is larger than the diameter of the form rolls at their axial ends. This is done to ensure proper contact between the form rolls and the plate cylinder. The present invention also encompasses a method of printing which reduces solid mottling and consumes less ink than in the prior art for an equivalent optical density.

39 Claims, 3 Drawing Sheets

APPARATUS AND METHOD FOR REDUCING MOTTLING IN PRINTING PRESSES

BACKGROUND OF THE INVENTION

1. Field of the Invention

The present invention relates to an apparatus and method for reducing mottling in printing presses. In particular, the present invention relates to form rolls which reduce solid mottling in an offset printing press.

2. Description of the Prior Art

Offset printing presses are well known in the printing art. In an offset printing press, an image or plate cylinder which contains on its outer surface an image to be printed rotates in contact with either the web or sheet upon which the image is to be printed, or preferably, rotates in contact with a transfer or blanket cylinder which transfers the image from the image cylinder to the web or sheet. Ink is transferred to the image cylinder, which ink is thereafter transferred either directly to the web or sheet or to the transfer cylinder and then to the web or sheet.

There are several known ways in which ink may be fed to an image cylinder in an offset printing press. The most common way of feeding ink to an image cylinder is through the use of an ink fountain. An ink fountain is a device in which a fountain roll has mounted against it a trough which is filled with ink. At the interface between the bottom of the trough (i.e., the ink fountain) and the fountain roll are located a series of ink keys. The ink keys may be moved toward and away from the fountain roll, and the distance between the end of each ink key and the surface of the fountain roll determines the thickness of ink applied by the ink key on the outer surface of the fountain roll. The fountain roll is in close proximity with, in an area past the ink keys in the direction of rotation of the fountain roll, a metering roll.

The metering roll feeds ink to an ink train of one or more rolls, which may include distribution rolls, vibrating rolls, swing rolls, and a form roll. The form roll transfers ink onto the plate cylinder. Prior art form rolls have been made with a outer elastomeric surface which is relatively soft, i.e., has a hardness on the order of 22–28 Shore A durometer hardness. The outer elastomeric surface is cylindrical and of a uniform outer diameter.

One disadvantageous result which can be found in prior art offset printing presses is solid mottle. Solid mottle is a condition of a printed image in which the ink is not distributed across the paper in a uniform manner, thereby resulting in a mottled image which does not have proper optical density across the entire image. In order to compensate for solid mottling, it has often been necessary in prior art devices to increase the amount of ink transferred to the paper.

SUMMARY OF THE INVENTION

The present invention relates to an apparatus and method which reduces solid mottling in a printing press. As a result, the present invention significantly increases the quality of the image printed by the printing press, by ensuring solid laydown of ink onto the printed web or sheet across the entire printed image. In addition, the present invention ensures that a proper optical density is achieved in the printed image with the consumption of less ink than in the prior art.

In the apparatus and method of the present invention, one or more form rolls having a hard elastomeric outer surface, in the range of approximately 60–90 Shore A durometer hardness, are used to transfer ink to the plate cylinder. A range of 50–100 Shore A durometer hardness may also be used for the outer surface of the roll. The use of a form roll of this type ensures a smoother application of ink to the plate cylinder, which in turn ensures smoother ink application to the blanket cylinder and printed web. If more than one form roll is used, it is preferable that, at a minimum, the final form roll, i.e., the last form roll the plate cylinder contacts in the direction of rotation, be a form roll with a hard elastomeric outer surface. Significantly improved results can be achieved when all of the form rolls have a hard elastomeric outer surface.

In another aspect of the present invention, the form rolls can be made of a convex shape along their axial length, such that the diameter of the hard elastomeric surface at its axial center is larger than the diameter of the hard elastomeric surface at its axial ends. This is done to ensure proper contact between the form rolls and the plate cylinder.

The present invention also encompasses a printing press which achieves high printing quality with low ink consumption. This is because the form rolls used in the present invention smoothly and evenly distribute ink on the plate cylinder, thereby requiring less ink be used on the plate cylinder to achieve a particular level of image quality. As a result, the present invention is an improvement over prior art printing presses which consume much more ink for a particular print quality.

The present invention also encompasses a method of printing which reduces solid mottling and consumes less ink than in the prior art for an equivalent optical density.

BRIEF DESCRIPTION OF THE DRAWING

The foregoing and other features of the present invention will become apparent to those skilled in the art to which the present invention relates from reading the following description with reference to the accompanying drawings, in which.

DETAILED DESCRIPTION OF THE INVENTION

Figure 1:
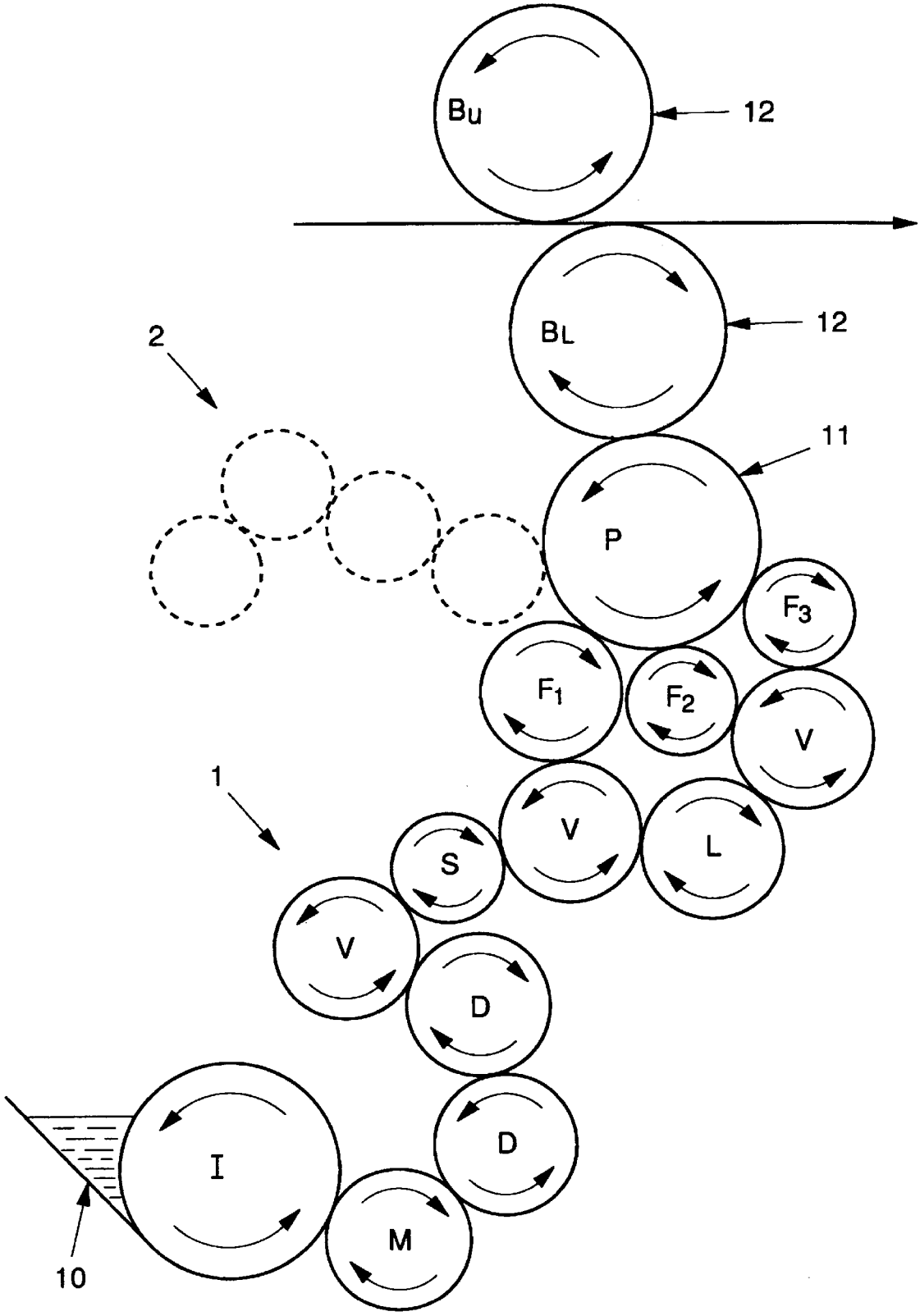
FIG. 1 is an elevational schematic view of an ink train for a offset printing press of the present invention.

FIG. 1 shows a schematic view of a printing press of the present invention. A web W of a material, e.g., paper, passes between and in contact with an upper blanket cylinder $B_U$ and a lower blanket cylinder $B_L$. The blanket cylinders $B_U$, $B_L$ may have mounted, on their outer surfaces, a printing blanket 12. The web W travels in the direction indicated by the arrow, and the blanket cylinders $B_U$, $B_L$ rotate in the directions shown by the arrows. For clarity, the plate cylinder and ink applicator used to transfer an inked image upon the upper blanket cylinder $B_U$ are not shown; it is to be understood that these components would be identical or similar to those which transfer an inked image to the lower blanket cylinder $B_L$.

An ink applicator of any known type can be used to apply ink to form rolls $F_1$, $F_2$, $F_3$; in FIG. 1 an ink train 1 is shown. Ink train 1 transfers ink to a plate cylinder P, which then transfers an inked image to the lower blanket cylinder $B_L$. An ink fountain roll I is located adjacent an ink fountain 10, and rotates so as to transfer a layer of ink from ink fountain 10 to a metering roll M. The manner in which ink fountain 10 transfers a layer of ink onto ink fountain roll I is known in the art. Metering roll M, in turn, transfers a layer of ink to a series of distribution rolls D. Ink is transferred from the distribution rolls D to vibrating rolls V, a swing roll S, and a large distribution roll L. Ink is applied by the vibrating rolls V to one or more form rolls $F_1$, $F_2$, $F_3$. The form rolls $F_1$, $F_2$, $F_3$ transfer a layer of ink onto the plate cylinder P. It is to be understood that it is not necessary to use three form rolls, and that any number of form rolls can be used to transfer ink to the plate cylinder P.

The printing press of the present invention can include a dampening apparatus 2, which is used to dampen the plate cylinder P as it comes off blanket cylinder $B_L$.

As is known in the art, the plate cylinder P contains on its outer surface a printing plate 11, which transfers an inked image onto the lower blanket cylinder $B_L$, for subsequent printing on the web W. The form rolls $F_1$, $F_2$, $F_3$ control the amount and quality of the ink layer transferred onto the plate cylinder P, and therefore the quality of the inked image on the web W.

Figure 2:
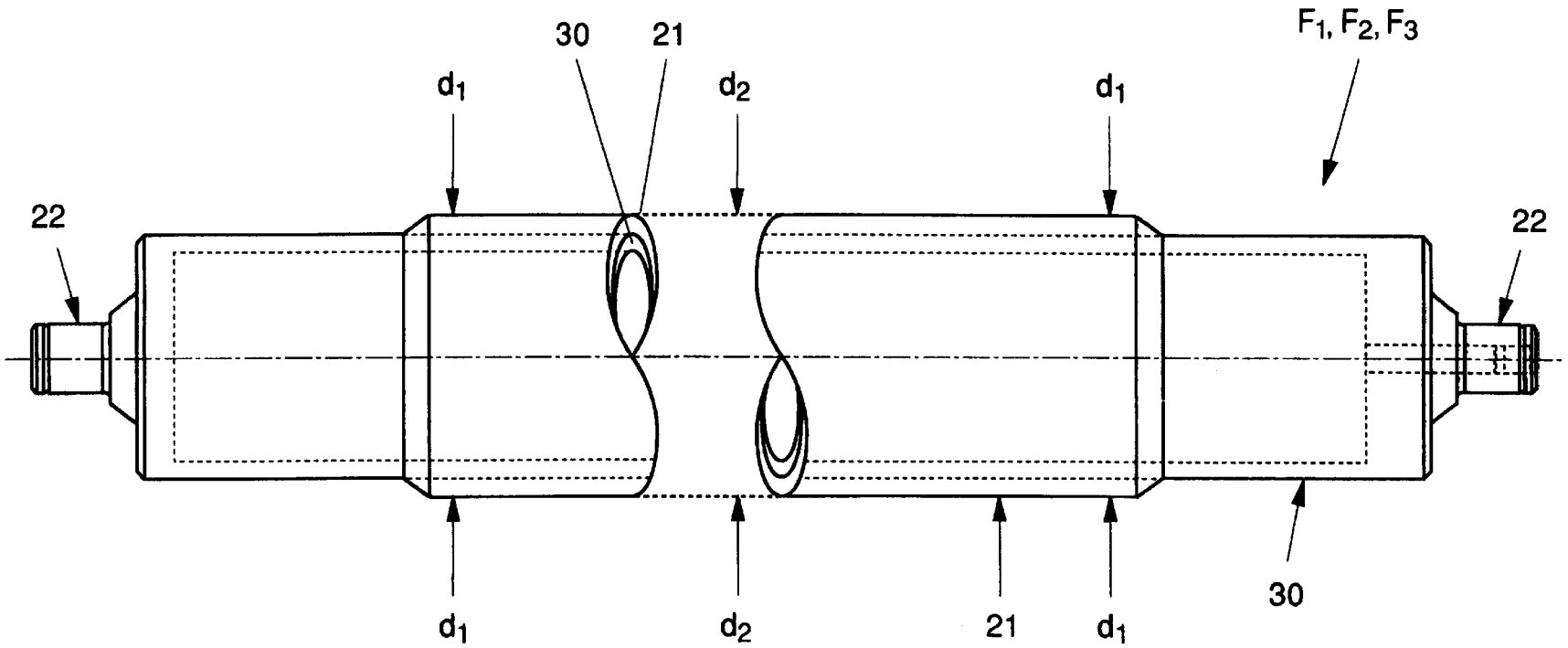
FIG. 2 is an elevational, partially broken-away, view of a first embodiment of a form roll of the present invention.
Figure 3:
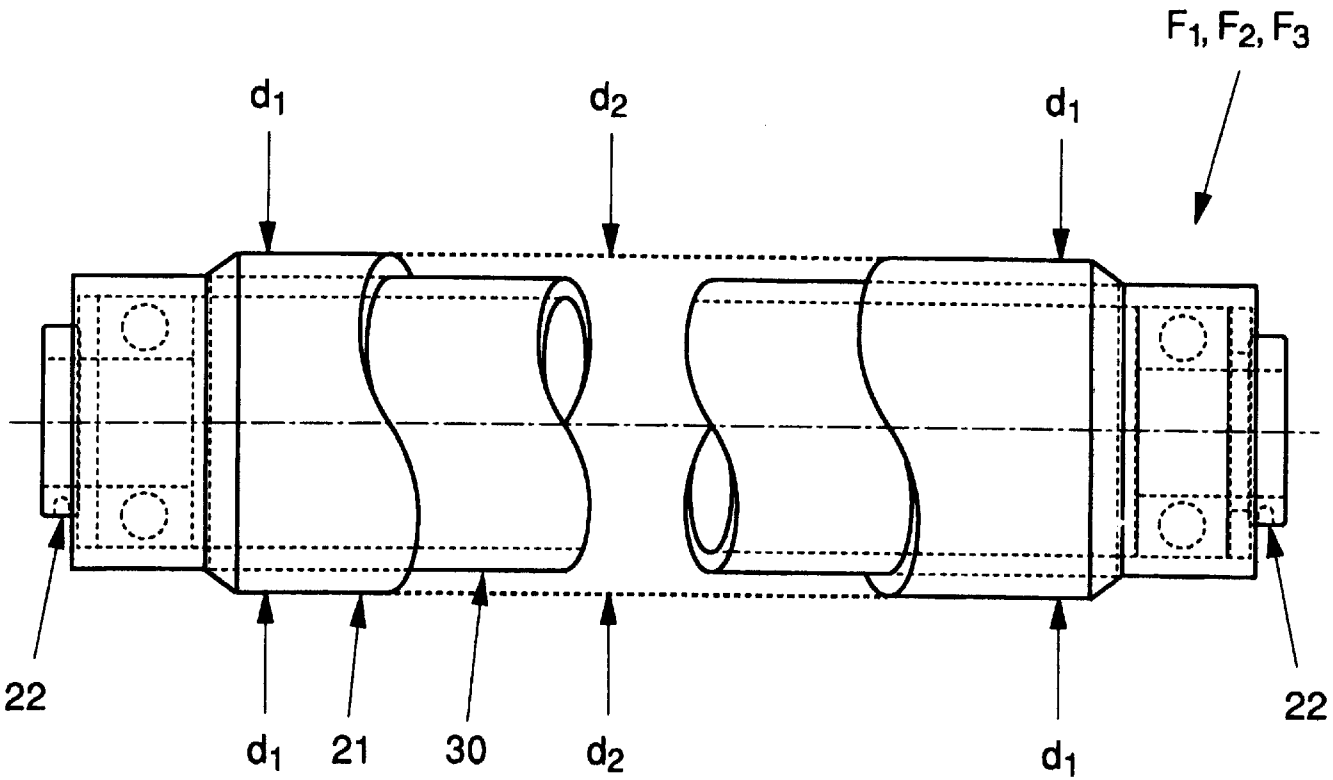
FIG. 3 is an elevational, partially broken-away, view of a second embodiment of a form roll of the present invention.

FIGS. 2 and 3 show two embodiments of a form roll $F_1$, $F_2$ or $F_3$ used with the present invention. The form roll $F_1$, $F_2$ or $F_3$ includes an inner portion 30 formed of a relatively durable and rigid material, such as steel. The inner portion 30 can include journals 22 at either end, which are used to rotatably mount the form roll $F_1$, $F_2$ or $F_3$. The inner portion 30 is preferably hollow, so as to reduce weight. The hollow center of inner portion 30 may include an appropriate cooling mechanism, e.g., a path for a cooling fluid, so as to prevent overheating of the form roll $F_1$, $F_2$ or $F_3$ during operation.

On at least a portion of the axial length of inner portion 30 is mounted an outer layer 21. Outer layer 21 is made of an elastomeric material, such as a Buna™ rubber compound or any other suitable compressible material. The elastomeric material of outer layer 21 is fabricated to be of relatively high hardness, which can be between 50–100 Shore A hardness, preferably between approximately 60–90 Shore A durometer hardness, and preferably approximately 80 Shore A durometer hardness. The increased hardness of the outer layer 21 produces superior results because the hardness of the outer layer 21 splits ink between the plate cylinder P and the form roll $F_1$, $F_2$ or $F_3$ with a finer and more uniform pattern. This improved ink splitting pattern translates into an improvement in ink solid laydown on the web W, after transfer of ink from the plate cylinder P to the blanket cylinder $B_L$. This smoother transfer of ink ensures that an image of high quality and high optical density can be created with less consumption of ink than in the prior art.

Because of the high hardness of the outer layer 21 of the form roll $F_1$, $F_2$ or $F_3$ of the present invention, the form roll $F_1$, $F_2$ or $F_3$ is more rigid in bending than form rolls of the prior art. As a result, the line of contact or "stripe" between the form roll and the plate cylinder is altered if a standard, uniform outer diameter form roll is used. To prevent alteration of the line of contact when using the form roll $F_1$, $F_2$ or $F_3$ of the present invention, a form roll $F_1$, $F_2$ or $F_3$ having a convex shape along the axial length may be used. In a convex form roll $F_1$, $F_2$ or $F_3$ according to this feature of the present invention, the diameter $d_1$ near the ends of the outer layer 21 is smaller than the diameter $d_2$ near the axial center of the outer layer 21. The degree of convexity, i.e., the shape of the convex curve forming the outer diameter of the outer layer 21 can be determined according to standard beam-bending algorithms or computer models which take into account the axial length, diameters, and materials of the form rolls $F_1$, $F_2$ and $F_3$.

If more than one form roll is used, it has been found to be most effective to place the form roll with an outer layer 21 with high hardness in the last position in the direction of rotation of the plate cylinder P, i.e., in FIG. 1, in the location of form roll $F_3$. More improved results are achieved if each of the form rolls $F_1$, $F_2$ and $F_3$ include an outer layer 21 with high hardness.

The use of a high hardness layer on the outer surface of the form rolls $F_1$, $F_2$ or $F_3$ can increase the temperature of the form rolls $F_1$, $F_2$ or $F_3$ while running. It may therefore be desirable to have a form roll cooling system (not shown) running, for example, through the hollow interior of the form roll $F_1$, $F_2$ or $F_3$. Such a cooling system could include passages for a cooling fluid in the interior of the form roll $F_1$, $F_2$ or $F_3$.

In the above description of the invention, those skilled in the art will perceive improvements, changes and modifications. Improvements, changes and modifications within the skill of the art are intended to be covered by the claims.

What is claimed is:

1. A form roll for use in a printing press comprising:

an inner portion; and an outer layer having a hardness of approximately 80 Shore A durometer hardness.

2. The form roll of claim 1, wherein:

the outer layer includes an elastomeric material, and wherein the elastomeric material is rubber.

3. The form roll of claim 1, wherein:

the inner portion is hollow.

4. A form roll for use in a printing press comprising:

an inner portion; and an outer layer, the outer layer having an outer surface, the outer surface being convex along an axial length of the outer layer.

5. The form roll of claim 4, wherein:

the outer layer has a hardness of between approximately 50 Shore A durometer hardness and 100 Shore A durometer hardness.

6. The form roll of claim 5, wherein:

the outer layer has a hardness of between approximately 60 Shore A durometer hardness and 90 Shore A durometer hardness.

7. The form roll of claim 6, wherein:

the outer layer has a hardness of approximately 80 Shore A durometer hardness.

8. The form roll of claim 4, wherein:

the outer layer includes an elastomeric material, and wherein the elastomeric material is rubber.

9. The form roll of claim 4, wherein:

the inner portion is hollow.

10. A printing press comprising:

a plate cylinder, the plate cylinder having a printing plate mounted on an outer surface of the plate cylinder;

at least one form roll contacting the plate cylinder, the at least one form roll including an inner portion and an outer layer, the outer layer having a hardness of approximately 80 Shore A durometer hardness.

11. The printing press of claim 10, wherein:

the outer layer includes an elastomeric material, and wherein the elastomeric material is rubber.

12. The printing press of claim 10, wherein:

the inner portion is hollow.

13. The printing press of claim 10, further comprising:

a blanket cylinder, the blanket cylinder contacting the plate cylinder.

14. The printing press of claim 10, further comprising:

an ink applicator, the ink applicator contacting the at least one form roll, the ink applicator applying ink to the at least one form roll.

15. The printing press of claim 10, further comprising:

a plurality of form rolls in contact with the plate cylinder.

16. A printing press comprising:

a plate cylinder, the plate cylinder having a printing plate mounted on an outer surface of the plate cylinder;

at least one form roll contacting the plate cylinder, the at least one form roll including an inner portion and an outer layer, the outer layer having an outer surface, the outer surface being convex along an axial length of the outer layer.

17. The printing press of claim 16, wherein:

the outer layer includes an elastomeric material, the outer layer having a hardness of between approximately 50 Shore A durometer hardness and 100 Shore A durometer hardness.

18. The printing press of claim 17, wherein:

the outer layer includes an elastomeric material, the outer layer having a hardness of between approximately 60 Shore A durometer hardness and 90 Shore A durometer hardness.

19. The printing press of claim 18, wherein:

the outer layer has a hardness of approximately 80 Shore A durometer hardness.

20. The printing press of claim 16, wherein:

the outer layer includes an elastomeric material, and wherein the elastomeric material is rubber.

21. The printing press of claim 16, wherein:

the inner portion is hollow.

22. The printing press of claim 16, further comprising:

a blanket cylinder, the blanket cylinder contacting the plate cylinder.

23. The printing press of claim 16, further comprising:

an ink applicator, the ink applicator contacting the at least one form roll, the ink applicator applying ink to the at least one form roll.

24. The printing press of claim 16, further comprising:

a plurality of form rolls in contact with the plate cylinder.

25. A method of printing comprising:

providing at least one form roll having an outer surface with a hardness of between approximately 50 Shore A durometer hardness and 100 Shore A durometer hardness;

providing a plate cylinder contacting the at least one form roll;

mounting a printing plate on an outer surface of the plate cylinder;

applying ink to the at least one form roll;

transferring ink from the at least one form roll to the printing plate.

26. The method of claim 25, wherein:

the outer surface has a hardness of between approximately 60 Shore A durometer hardness and 90 Shore A durometer hardness.

27. The method of claim 26, wherein:

the outer surface has a hardness of approximately 80 Shore A durometer hardness.

28. The method of claim 25, wherein:

the outer surface is convex along at least a portion of an axial length of the form roll.

29. The method of claim 25, further comprising:

providing a blanket cylinder contacting the plate cylinder; and transferring ink from the plate cylinder to the blanket cylinder.

30. The method of claim 25, further comprising:

providing an ink applicator contacting the at least one form roll; and wherein the ink applicator applies ink to the at least one form roll.

31. The method of claim 25, further comprising:

providing a plurality of form rolls in contact with the plate cylinder.

32. A method of printing comprising:

providing at least one form roll having an outer surface which is convex along at least a portion of an axial length of the at least one form roll;

providing a plate cylinder contacting the at least one form roll;

mounting a printing plate on an outer surface of the plate cylinder;

applying ink to the at least one form roll;

transferring ink from the at least one form roll to the printing plate.

33. The method of claim 32, wherein:

the outer surface has a hardness of between approximately 50 Shore A durometer hardness and 100 Shore A durometer hardness.

34. The method of claim 33, wherein:

the outer surface has a hardness of between approximately 60 Shore A durometer hardness and 90 Shore A durometer hardness.

35. The method of claim 34, wherein:

the outer surface has a hardness of approximately 80 Shore A durometer hardness.

36. The method of claim 32, further comprising:

providing a blanket cylinder contacting the plate cylinder; and transferring ink from the plate cylinder to the blanket cylinder.

37. The method of claim 32, further comprising:

providing an ink applicator contacting the at least one form roll; and wherein the ink applicator applies ink to the at least one form roll.

38. The method of claim 32, further comprising:

providing a plurality of form rolls in contact with the plate cylinder.

39. A printing press comprising:

a plate cylinder, the plate cylinder having a printing plate mounted on an outer surface of the plate cylinder;

at least one form roll contacting the plate cylinder, the at least one form roll including an inner portion and an outer layer, the outer layer having an outer surface, and wherein the outer surface is convex along an axial length of the outer layer.

* * * * *